US008419224B2

(12) United States Patent
Wan-Chih et al.

(10) Patent No.: US 8,419,224 B2
(45) Date of Patent: Apr. 16, 2013

(54) LIGHT-EMITTING DIODE STREETLIGHT STRUCTURE

(75) Inventors: Lin Wan-Chih, Hsinchu (TW); Tai Yi-Ming, Hsinchu (TW); Yang Cheng-Wei, Hsinchu (TW); Wu Chia-Wen, Hsinchu (TW); Chen Shun-Chih, Hsinchu (TW)

(73) Assignee: Optotech Corporatipn, Hsinchu (TW)

( * ) Notice: Subject to any disclaimer, the term of this patent is extended or adjusted under 35 U.S.C. 154(b) by 105 days.

(21) Appl. No.: 12/986,851

(22) Filed: Jan. 7, 2011

(65) Prior Publication Data

US 2012/0127727 A1 May 24, 2012

(30) Foreign Application Priority Data

Nov. 24, 2010 (TW) ..... 99222741 U

(51) Int. Cl.
*F21L 4/00* (2006.01)

(52) U.S. Cl.
USPC ..... 362/294; 362/800; 362/373; 362/249.02

(58) Field of Classification Search ..... 362/373, 362/294, 249.02, 800
See application file for complete search history.

(56) References Cited

U.S. PATENT DOCUMENTS

| | | | | |
|---|---|---|---|---|
| 6,193,392 | B1 * | 2/2001 | Lodhie | 362/235 |
| 7,922,372 | B2 * | 4/2011 | Li | 362/373 |
| 8,157,413 | B2 * | 4/2012 | Maxik et al. | 362/244 |
| 8,172,425 | B2 * | 5/2012 | Wen et al. | 362/249.02 |
| 8,186,845 | B2 * | 5/2012 | Zheng | 362/183 |

* cited by examiner

*Primary Examiner* — Anabel Ton
(74) *Attorney, Agent, or Firm* — Muncy, Geissler, Olds & Lowe, PLLC

(57) ABSTRACT

The present invention relates to a light-emitting diode (LED) streetlight structure, which comprises a light-emitting module, a power module, and a lamppost. The light-emitting module is disposed on one side of the power module; the lamppost is disposed on the other side of the power module and corresponds to the light-emitting module. The light-emitting module comprises a light-emitting device and a heat-dissipating base for the light-emitting apparatus to be disposed on. The light-emitting apparatus includes a plurality of light-emitting diodes (LEDs) and a plurality of protection devices connected electrically with the plurality of LEDs. The plurality of protection devices are used for protecting the corresponding plurality of LEDs for preventing the situation when the light-emitting apparatus is failed caused by the damage of one of the plurality of LEDs.

15 Claims, 5 Drawing Sheets

LIGHT-EMITTING DIODE STREETLIGHT STRUCTURE

FIELD OF THE INVENTION

The present invention relates generally to a streetlight structure, and particularly to a light-emitting diode (LED) streetlight structure.

BACKGROUND OF THE INVENTION

LEDs are diodes capable of emitting light when forward biased. They are light-emitting devices manufactured by semiconductor materials mostly including chemical elements, such as gallium phosphide or gallium arsenide in the early days and aluminum-gallium-indium phosphide or gallium-indium nitride for high-brightness LEDs at present day. The light-emitting principle is to apply a current to the compound semiconductor. Then part of the energy will be released in the form of light via recombination of electrons and holes and thus achieving light-emitting effect.

Because the used materials are different, the energy levels of electrons and holes in LEDs differ. When the electrons and holes recombine, the released photons will hence have different energies, resulting in light with different wavelengths, which are light with different colors such as red, orange, yellow, green, blue, or invisible light.

Different from earlier light sources, LEDs are luminescent with low power consumption, long lifetime, no warm-up time, fast response, and small size. Besides, they are vibration tolerant, suitable for mass production, and easy to be manufactured extremely small or in arrays according to requirements of applications. Currently, LEDs are widely applied to indicators and displays of information, communication, and consumer electronic products, and thereby they have become indispensable important devices in daily lives.

As the LED technology becomes increasingly mature, its application areas are becoming wider. In the residence area, the applications include wall lamps, night lamps (the requirement in brightness for this application is not high, and thereby is the earliest application of LEDs), auxiliary lighting, garden lamps, and reading lamps. In the equipment area, the applications include emergency indicators and hospital bed lamps. In the store area, their applications include spotlights, embedded lamps, barrel lamps, and light bars. In the outdoor applications, LEDs can be used to decorate the appearance of buildings and used in solar-energy lamps. In addition, they can also applied to light shows.

The lighting market is long considered as the greatest and potential market of LEDs, even though no major lighting product is proposed owing to cost and performance limitations. However, it is undeniable that LED technology has been developing rapidly in recent years, making it to occupy some market in the special light market, such as the niche markets of freezer lighting, aviation lamps, or traffic lights). In the general lighting market, including barrel lamps, embedded lamps, spotlights, and landscape lighting products, some products start to replace traditional light sources such as halogen lamps or incandescent lamps.

Current LED streetlight includes at least an LED module composed of a plurality of LEDs. When one of the plurality of LEDs is damaged, the LED module will fail to illuminate.

To solve the problem described above, the present invention provides an LED streetlight structure including a plurality of protection devices connected electrically with the corresponding plurality of LEDs. The plurality of protection devices are used for protecting the corresponding plurality of LEDs for preventing the situation when the light-emitting apparatus is failed caused by the damage of one of the plurality of LEDs.

SUMMARY

An objective of the present invention is to provide an LED streetlight structure including a plurality of protection devices connected electrically with the corresponding plurality of LEDs. The plurality of protection devices are used for protecting the corresponding plurality of LEDs for preventing the situation when the light-emitting apparatus is failed caused by the damage of one of the plurality of LEDs.

For achieving the objective described above, the present invention provides an LED streetlight structure comprising a light-emitting module, a power module, and a lamppost. The light-emitting module comprises at least a light-emitting apparatus and a heat-dissipating base, wherein the light-emitting apparatus is disposed on the heat-dissipating base. The light-emitting apparatus at least includes a circuit board, a plurality of LEDs, and a plurality of protection devices. The plurality of LEDs and the plurality of protection devices are disposed on the circuit board. The plurality of protection devices are connected electrically with the plurality of LEDs. The power module is disposed on one side of the light-emitting module and is connected electrically with the plurality of LEDs and the plurality of protection devices of the light-emitting apparatus. The lamppost is disposed on one side of the power module and corresponds to the light-emitting module.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
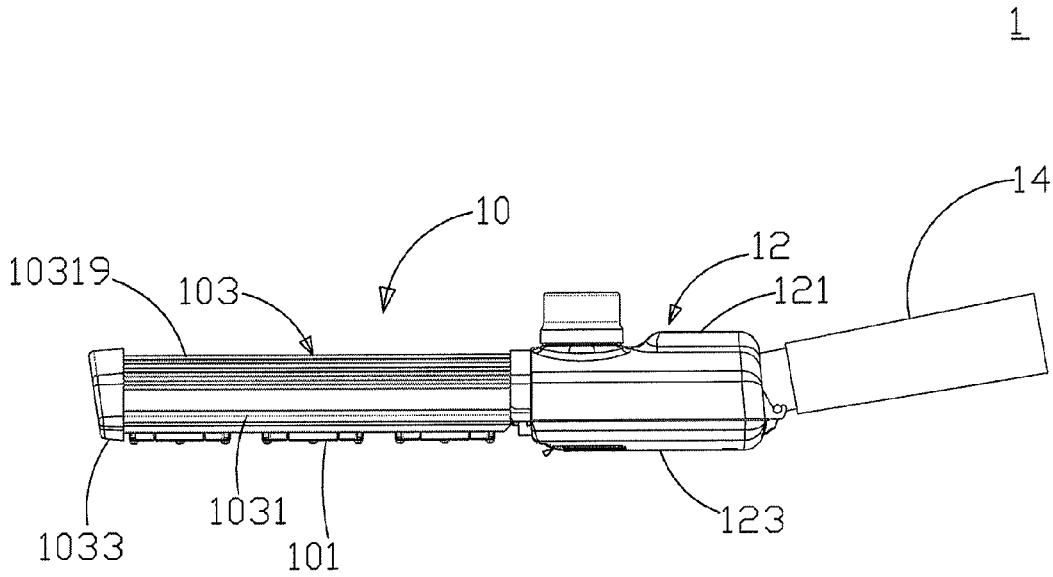
FIG. 1 shows a three-dimensional view of the LED streetlight structure according to a preferred embodiment of the present invention.

FIG. 1 shows a three-dimensional view of the LED streetlight structure according to a preferred embodiment of the present invention. As shown in the figure, the present invention provides an LED streetlight structure 1, which comprises a light-emitting module 10, a power module 12, and a lamppost 14. The light-emitting module 10 is disposed on one side of the power module 12. The lamppost 14 is disposed on the other side of the power module 12 and corresponds to the light-emitting module 10. The light-emitting module 10 comprises at least a light-emitting apparatus 101 and a heat-dissipating base 103. The light-emitting apparatus 101 is disposed on the heat-dissipating base 103.

Figure 2:
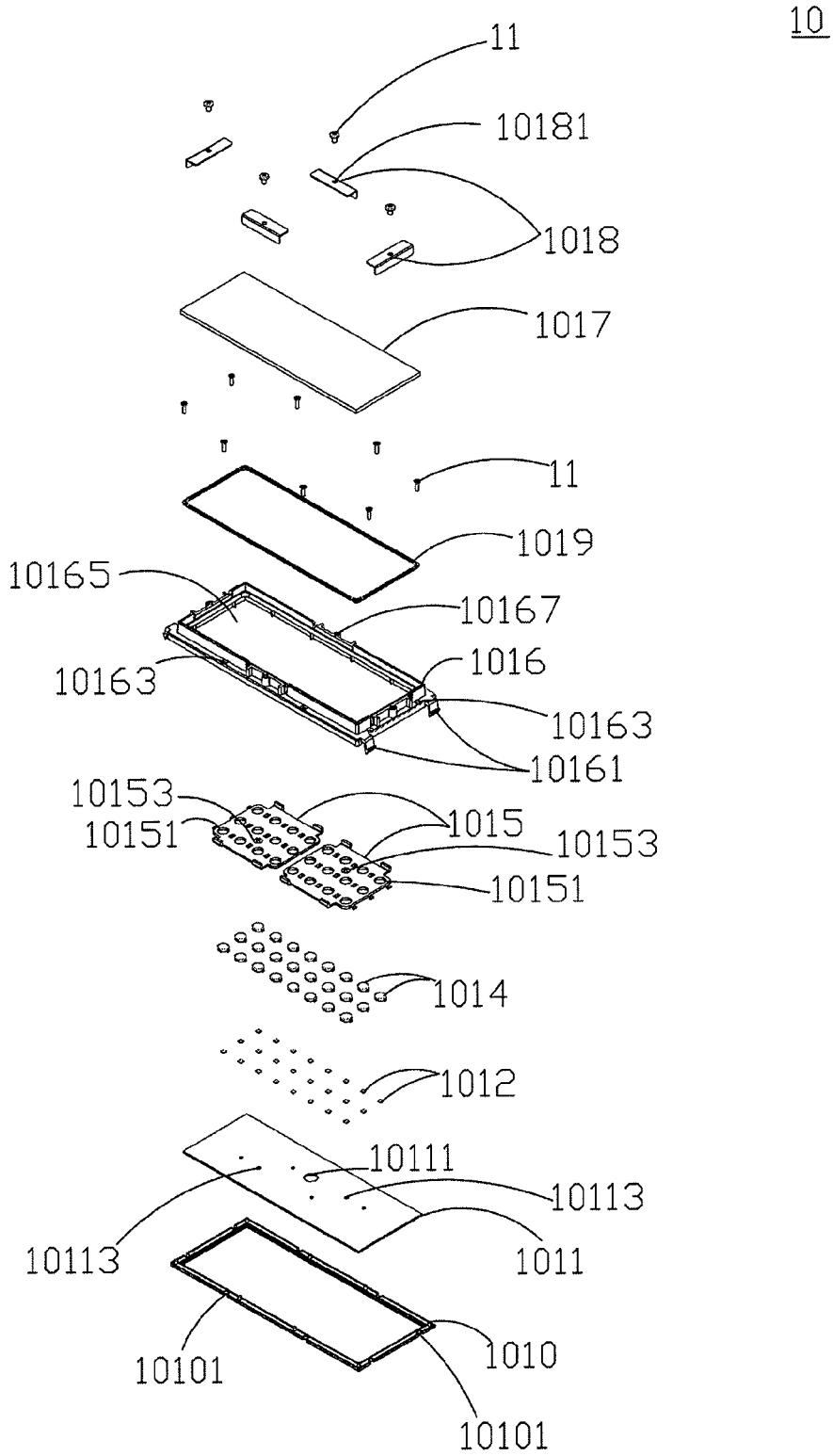
FIG. 2 shows an exploded view of the light-emitting apparatus according to a preferred embodiment of the present invention.
Figure 3:
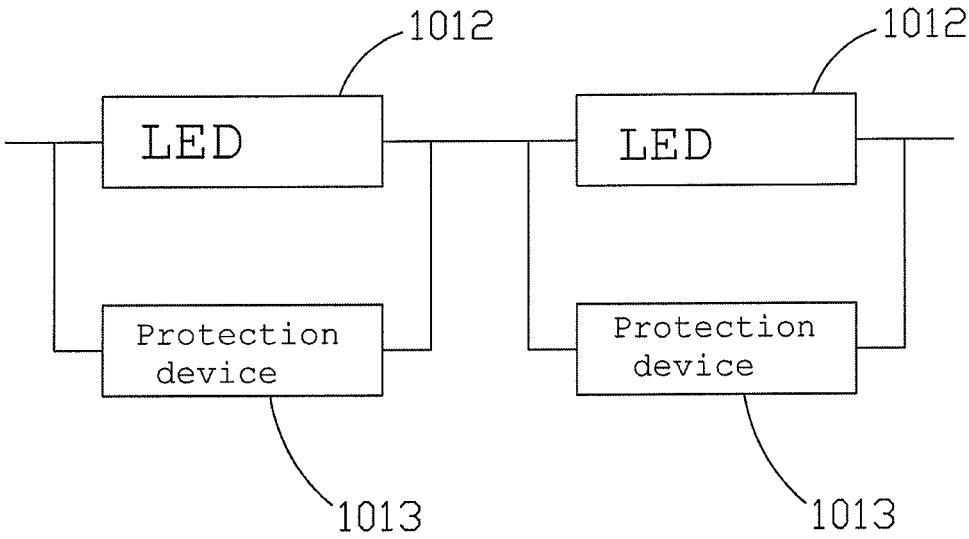
FIG. 3 shows a circuit diagram of the LEDs and protection devices according to a preferred embodiment of the present invention.

FIG. 2 shows an exploded view of the light-emitting apparatus according to a preferred embodiment of the present invention; FIG. 3 shows a circuit diagram of the LEDs and protection devices according to a preferred embodiment of the present invention. As shown in the figures, the light-emitting apparatus 101 includes a base 1010, a circuit board 1011, a plurality of LEDs 1012, a plurality of protection devices 1013, a plurality of lenses 1014, two lens frames 1015, a frame 1016, and a glass sheet 1017. The heat-dissipating base 103 includes a heat-dissipating body 1031 and a heat-dissipating cover 1033.

The circuit board 1011 is disposed on the base 1010. There is a first positioning hole 10111 at the center of the circuit board 1011. The heat-dissipating body 1031 has a first fixing hole 10311, which corresponds to the first positioning hole 10111 of the circuit board 1011. Then, a fixing member 11 (not shown in the figure) is used for passing through the first positioning hole 10111 of the circuit board 1011. The fixing member 11 is fastened to the first fixing hole 10311 of the heat-dissipating body 1031. Thereby, the circuit board 1011 is fixed on the heat-dissipating body 1031.

The plurality of LEDs 1012 and the plurality of protection devices 1013 are disposed on the circuit board 1011. The plurality of LEDs 1012 connect electrically to a plurality of contacts (not shown in the figure). The plurality of protection devices 1013 connect electrically with the corresponding plurality of LEDs 1012 (refer to FIG. 3). The plurality of protection devices 1013 are used for protecting the plurality of LEDs 1012, for preventing damages on the plurality of LEDs caused by external surges. This is because if one of the plurality of LEDs 1012 is damaged, the whole light-emitting apparatus 101 has to be replaced.

The plurality of lenses 1014 are disposed on the corresponding plurality of LEDs 1012, respectively. The two lens frames 1015 are disposed on the circuit board 1011. The two lens frames 1015 have a plurality of bores 10151, which are arranged according to the locations of the plurality of LEDs 1012 having the plurality of lenses 1014. Each bore 10151 corresponds to an LED 1012 among the plurality of LEDs 1012. Each of the two lens frames 1015 has a positioning hole 10153, respectively. The circuit board 1011 has two first holes 10113 corresponding to the two positioning holes 10153. The heat-dissipating body 1031 has two second fixing holes 10313 corresponding to the two first holes 10113 of the circuit board 1011. Two fixing members (not shown in the figure) pass through the two positioning holes 10153 corresponding to the two lens frames 1015 and the two first holes 10113 of the circuit board 1011. The two fixing members are fastened to the two second fixing holes 10313 corresponding to the heat-dissipating body 1031. Hence, the positions of the two lens frames 1015 can be fixed.

The frame 1016 is fixed on the heat-dissipating body 1031 and accommodates the base 1010, the circuit board 1011, the plurality of LEDs 1012, the plurality of protection devices 1013, the plurality of lenses 1014, and the two lens frames 1015. At least a sliding block 10161 is disposed on each side of the frame 1016. A sliding trench 10315 is disposed on each side of the heat-dissipating body 1031. The plurality of sliding blocks 10161 on both sides of the frame 1016 slide into the corresponding sliding trenches 10315, respectively. The frame 1016 moves to the location above the base 1010, the circuit board 1011, the plurality of LEDs 1012, the plurality of protection devices 1013, the plurality of lenses 1014, and the two lens frames 1015. A plurality of positioning holes 10163 are disposed on the periphery of the frame 1016; a plurality of holes 10101 are disposed on the periphery of the base 1010. The plurality of holes 10101 correspond to the plurality of positioning holes 10163. The heat-dissipating body 1031 has a plurality of third fixing holes 10317 corresponding to the plurality of holes 10101 of the base 1010. A plurality of fixing members 11 thread through the plurality of positioning holes 10163 of the frame 1016 and the plurality of holes 10101 of the base 1010. The plurality of fixing members 11 are fastened to the corresponding plurality of third fixing holes 10317 of the heat-dissipating body 1031, and hence fixing the position of the frame 1016.

The frame 1016 has an opening 10165, and the glass sheet 1017 is disposed at the opening 10165 of the frame 1016. For avoiding the glass sheet 1017 from escaping the opening 10165 of the frame 1016, the light-emitting apparatus 101 according to the present invention further has four pressure plates 1018 disposed at the four sides of the opening 10165 of the frame 1016. When the glass sheet 1017 is disposed at the opening 10165 of the frame 1016, the four pressure plates 1018 press the glass sheet 1017 and securing the frame 1016. Thereby, the glass sheet 1017 can be fixed, avoiding it from escaping the opening 10165 of the frame 1016. In the following, how the four pressure plates 1018 are fixed on the frame 1016 is described. Each pressure plate 1018 has a positioning hole 10181. A fixing hole 10167 is disposed on each side of the opening 10165 of the frame 1016. Then, four positioning members 11 are used for passing through the positioning hole 10181 of the pressure plate 1018 and fastened at the corresponding fixing hole 10167 of the frame 1016. Accordingly, the four pressure plates 1018 are secured on the frame 1016.

In order to prevent exterior moisture from entering the light-emitting apparatus 101, a washer 1019 is further disposed between the glass sheet 1017 and the opening 10165 of the frame 1016 for increasing closeness therebetween and thus preventing exterior moisture from entering the light-emitting apparatus 101.

Refer again to FIG. 1. The heat-dissipating body 1031 of the heat-dissipating base 103 has a plurality of heat-dissipating fins 10319. By taking advantage of the large areas of the plurality of heat-dissipating fins 10319 for increasing heat-dissipating areas, the heat generated by the light-emitting apparatus 101 can be dissipated, and hence reducing the temperature of the light-emitting apparatus 101 and enhancing the lifetime and light-emitting efficiency of the light-emitting apparatus 101. The heat-dissipating body 1031 according to the present embodiment further has a plurality of heat-dissipating holes 10312. Thereby, the heat generated by the light-emitting apparatus 101 can be dissipated rapidly.

Figure 4:
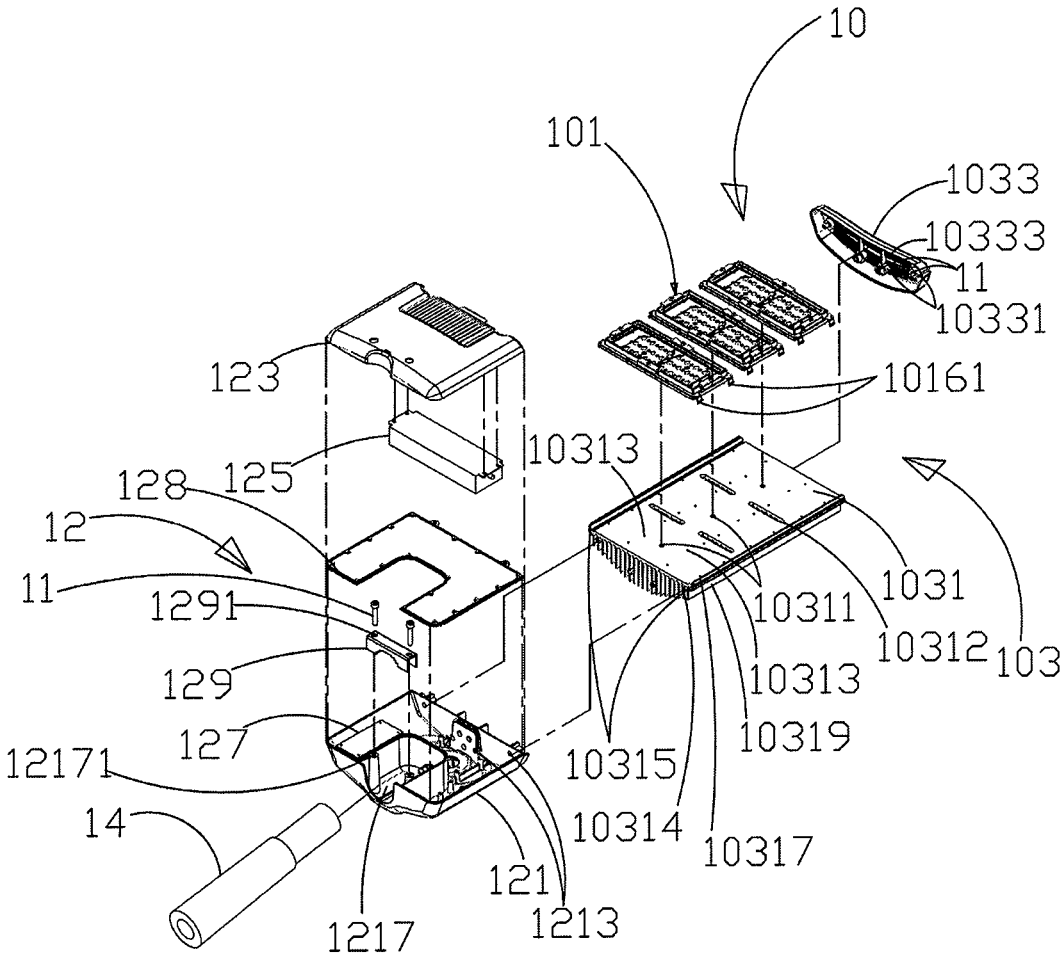
FIG. 4 shows an exploded view of the LED streetlight structure according to a preferred embodiment of the present invention.

FIG. 4 shows an exploded view of the LED streetlight structure according to a preferred embodiment of the present invention. As shown in the figure, the heat-dissipating cover 1033 of the heat-dissipating base 103 is disposed at on end of the heat-dissipating body 1031 and corresponds to the power module 12. The heat-dissipating cover 1033 has a plurality of positioning holes 10331. The heat-dissipating body 1031 also has a plurality of fourth fixing holes (not shown in the figure) at one end. The plurality of fourth fixing holes correspond to the plurality of positioning holes 10331 of the heat-dissipating cover 1033. Then pass a plurality of fixing members 11 through the corresponding the plurality of positioning holes 10331 of the heat-dissipating cover 1033 and fasten them to the plurality of fourth fixing holes of the heat-dissipating body 1031. The heat-dissipating cover 1033 also has a plurality of heat-dissipating holes 10333 for improving heat dissipation of the heat-dissipating base 103 effectively.

Refer again to FIG. 4. The power module 12 comprises a first housing 121, a second housing 123, a power supply 125, and a driving circuit board 127. The power supply 125 is disposed in the second housing 123; the driving circuit board 127 is disposed in the first housing 121. The power supply 125 described above can be fixed in the second housing 123 using fasteners; the driving circuit board 127 can also be fixed in the first housing 121 using fasteners. When the power supply 125 and the driving circuit board 127 of the power module 12 are damaged, it is only necessary to disassemble and replace the power supply 125 and the driving circuit board 127 without replacing the whole power module 12.

The power supply 125 connects to the driving circuit board 127, which, in turn, connects to the plurality of LEDs 1012 and the plurality of protection devices 1013 of the light-emitting module 10 disposed on the circuit board 1011. The power supply 125 can supply power to the driving circuit board 127; the driving circuit board 127 drives the plurality of LEDs 1012 and the plurality of protection devices 1013. The second housing 123 having the power supply 125 is disposed in the first housing 121 having the driving circuit board 127. In order to avoid moisture from entering the power module 12, the power module 12 according to the present embodiment further comprises a washer 128 disposed between the first and the second housings 101, 103 for increasing closeness therebetween.

Refer again to FIGS. 1 to 4. The power module 12 is disposed on one side of the light-emitting module 10. The connection between the power module 12 and the light-emitting module 10 is described as follows. The first housing 121 of the power module 12 has a plurality of positioning holes 1213 on the surface adjacent to the light-emitting module 10. The heat-dissipating body 1031 of the light-emitting module 10 has a plurality of fifth fixing holes 10314 on the surface adjacent to the power module 12. A plurality of fixing members (not shown in the figure) pass through the corresponding plurality of positioning holes 1213 of the first housing 121 of the power module 12 and are fastened to the corresponding plurality of fifth fixing holes 10314 of the heat-dissipating body 1031 of the light-emitting module 10. When the light-emitting module 10 or the power module 12 is damaged, only the light-emitting module 10 or the power module 12 has to be replaced, not necessary to replace the whole LED streetlight structure 1.

The lamppost 14 is disposed on the other side of the power module 12 and corresponds to the light-emitting module 10. The first housing 121 of the power module 12 has an assembly cavity 1217; the lamppost 14 is disposed in the assembly cavity 1217. The power module 12 further includes a limiter 129, which is sawtooth-shaped and located on the lamppost 14, and is fixed in the assembly cavity 1217 of the first housing 121. A positioning hole 1291 is disposed on each of the both ends of the limiter 129, respectively. Two fixing holes 12171 are disposed in the assembly cavity 1217 and correspond to the two positioning holes 1291 of the limiter 129. Two fixing members 11 pass through the corresponding two positioning holes 1291 of the limiter 129, and are fastened to the corresponding two fixing holes 12171 of the assembly cavity 1217. Thereby, the limiter 129 is secured in the assembly cavity 1217 and is located on the lamppost 14. The limiter 129 limits the lamppost 14 in the assembly cavity 1217 of the first housing 121.

Figure 5:
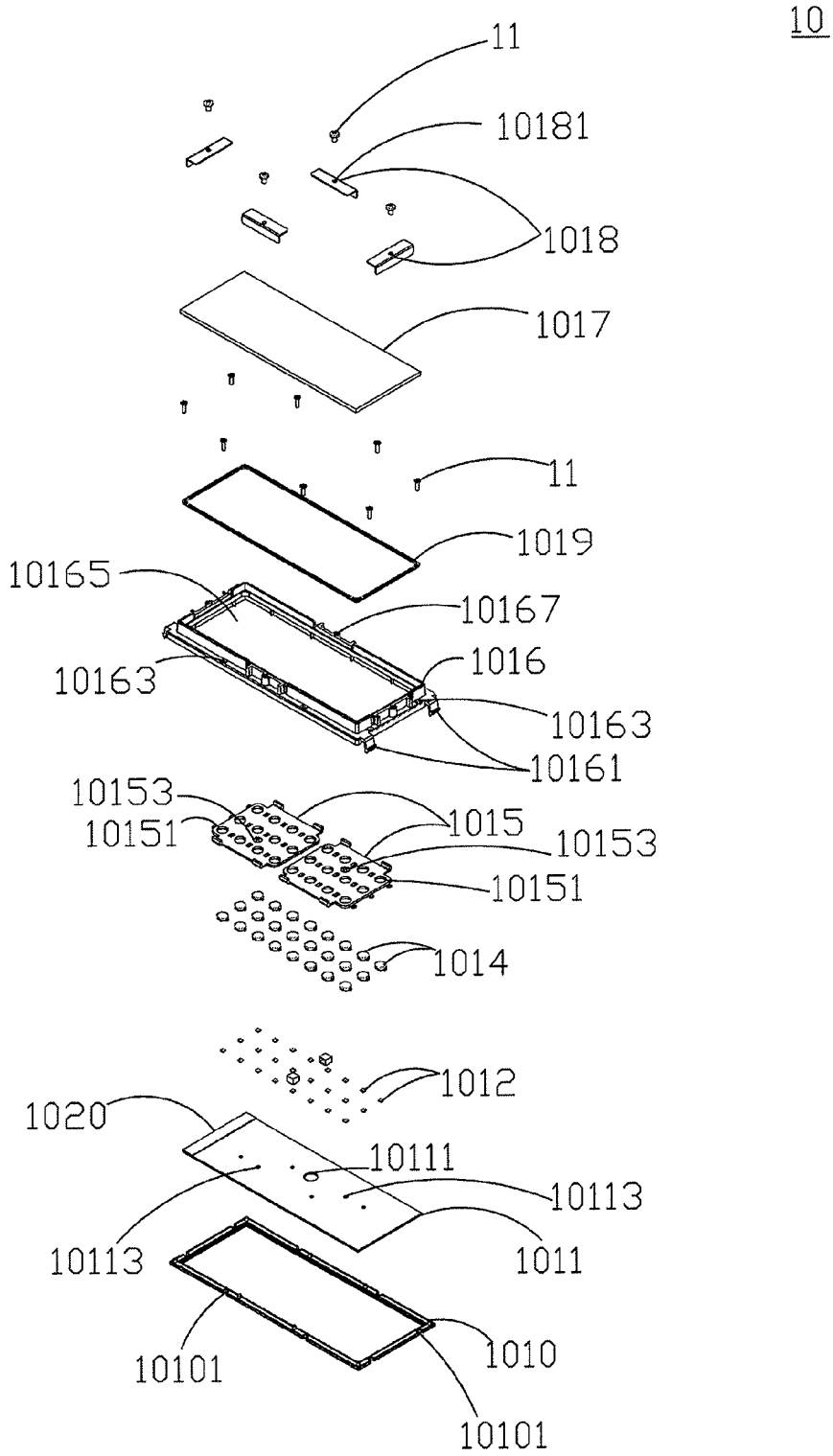
FIG. 5 shows an exploded view of the light-emitting apparatus according to another preferred embodiment of the present invention.

FIG. 5 shows an exploded view of the light-emitting apparatus according to another preferred embodiment of the present invention. As shown in the figure, according to the present embodiment, the driving circuit board 127 of the power module 12 according to the embodiment in FIG. 4 is integrated to the circuit board 1011 of the light-emitting apparatus 10 for reducing the number of components of the LED streetlight structure 1. The light-emitting apparatus 10 further comprises a driving circuit 1020 disposed on the circuit board 1011 of the light-emitting apparatus 10 and connected electrically with the plurality of LEDs 1012 and the plurality of protection devices 1013. The power supply 125 of the power module 12 connects electrically to the driving circuit 1020 of the light-emitting apparatus 10 directly. The power supply 125 supplies power to the driving circuit 1020 of the light-emitting apparatus 10. Then the driving circuit 1020 drives the plurality of LEDs 1012 and the plurality of protection devices 1013.

It is known from above that the present invention provides an LED streetlight structure. The LED streetlight structure according to the present invention has a plurality of protection devices. The plurality of protection devices are used for protecting the corresponding plurality of LEDs for preventing the situation when the light-emitting apparatus is failed caused by the damage of one of the plurality of LEDs. Moreover, the LED streetlight structure according to the present invention integrates the driving circuit to the circuit board of the light-emitting apparatus, and thus reducing the number of components.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A light-emitting diode streetlight structure, comprising:

a light-emitting module, comprising at least a light-emitting apparatus and a heat-dissipating base, said light-emitting apparatus disposed on said heat-dissipating base, said light-emitting apparatus at least comprising a circuit board, a plurality of light-emitting diodes, and a plurality of protection devices, said plurality of light-emitting diodes and said plurality of protection devices disposed on said circuit board, and said plurality of protection devices connecting electrically with said corresponding plurality of light-emitting diodes in parallel connection for preventing damages on the plurality of LEDs caused by external surges;

a power module, disposed on one side of said light-emitting module, and connecting electrically with said plurality of light-emitting diodes and said plurality of protection devices; and a lamppost, disposed on one side of said power module, and corresponding to said light-emitting module.

2. The light-emitting diode streetlight structure of claim 1, wherein said light-emitting apparatus further comprises a driving circuit, disposed on said circuit board of said light-emitting apparatus, connecting electrically with said plurality of light-emitting diodes and said plurality of protection devices, and connecting electrically with said power module.

3. The light-emitting diode streetlight structure of claim 1, wherein said heat-dissipating base comprises:

a heat-dissipating body, disposed on one side of said power module; and a heat-dissipating cover, disposed on the other side of said heat-dissipating body, and corresponding to said heat-dissipating body.

4. The light-emitting diode streetlight structure of claim 3, wherein said heat-dissipating body has a plurality of heat-dissipating fins.

5. The light-emitting diode streetlight structure of claim 4, wherein said heat-dissipating body has a plurality of heat-dissipating holes.

6. The light-emitting diode streetlight structure of claim 3, wherein said heat-dissipating cover has a plurality of heat-dissipating holes.

7. The light-emitting diode streetlight structure of claim 3, wherein said light-emitting apparatus further comprises:

a base, disposed in said heat-dissipating body, and said circuit board disposed on said base;

a plurality of lenses, disposed on said corresponding light-emitting diodes, respectively;

at least a lens frame, disposed on said circuit board, having a plurality of bores corresponding to said plurality of light-emitting diodes and said plurality of protection devices;

a frame, disposed on said heat-dissipating body, accommodating said base, said circuit board, said plurality of light-emitting diodes, said plurality of lenses, and said lens frame, and having an opening; and a glass sheet, disposed on said opening of said frame.

8. The light-emitting diode streetlight structure of claim 7, wherein said light-emitting apparatus further comprises a washer disposed between said opening of said frame and said glass sheet.

9. The light-emitting diode streetlight structure of claim 7, wherein said light-emitting apparatus further comprises a plurality of pressure plates, disposed at the periphery of said glass sheet, and fixed on said frame for fixing said glass sheet on said opening of said frame.

10. The light-emitting diode streetlight structure of claim 7, wherein said heat-dissipating body has a sliding trench on each of both sides, respectively; said frame has at least a sliding block on each of both sides, respectively; said plurality of sliding blocks correspond to said plurality of sliding trenches; and said plurality of sliding blocks are slidably disposed in said plurality of sliding trenches.

11. The light-emitting diode streetlight structure of claim 2, wherein said power module comprises: a first housing, disposed on one side of said heat-dissipating base of said light-emitting module; a second housing, disposed in said first housing; and a power supply, disposed in said second housing, connecting electrically with said driving circuit of said light-emitting apparatus.

12. The light-emitting diode streetlight structure of claim 11, wherein said first housing has an assembly cavity, and said lamppost is disposed in said assembly cavity.

13. The light-emitting diode streetlight structure of claim 12, wherein said power module further comprises a limiter, located on said lamppost, and fixed in said assembly cavity.

14. The light-emitting diode streetlight structure of claim 11, wherein said power module further comprises a washer disposed between said first housing and said second housing.

15. The light-emitting diode streetlight structure of claim 1, wherein said power module comprises: a first housing, disposed on one side of said heat-dissipating base of said light-emitting module; a driving circuit board, disposed in said first housing; a second housing, disposed in said first housing; and a power supply, disposed in said second housing, connecting electrically with said driving circuit board, said driving circuit board connecting electrically with said plurality of light-emitting diodes and said plurality of protection devices of said light-emitting apparatus of said light-emitting module.

* * * * *